US006741714B2

(12) United States Patent
Jensen

(10) Patent No.: US 6,741,714 B2
(45) Date of Patent: May 25, 2004

(54) HEARING AID WITH ADAPTIVE MATCHING OF INPUT TRANSDUCERS

(75) Inventor: Lars Baekgaard Jensen, Farum (DK)

(73) Assignee: Widex A/S, Vaerloese (DK)

( * ) Notice: Subject to any disclaimer, the term of this patent is extended or adjusted under 35 U.S.C. 154(b) by 331 days.

(21) Appl. No.: 09/887,260

(22) Filed: Jun. 25, 2001

(65) Prior Publication Data

US 2002/0041696 A1 Apr. 11, 2002

(30) Foreign Application Priority Data

Oct. 4, 2000 (DK) ..... PA 2000 01475
May 10, 2001 (EP) ..... 01610048

(51) Int. Cl.[7] ..... H04R 25/00

(52) U.S. Cl. ..... 381/313; 381/312; 381/320; 381/321; 381/92

(58) Field of Search ..... 381/312, 91, 92, 381/111, 122, 313, 320, 321, 1

(56) References Cited

U.S. PATENT DOCUMENTS 5,572,591 A * 11/1996 Numazu et al. ..... 381/1
5,680,467 A * 10/1997 Hansen ..... 381/312
5,757,933 A * 5/1998 Preves et al. ..... 381/313
6,539,096 B1 * 3/2003 Sigwanz et al. ..... 381/313

FOREIGN PATENT DOCUMENTS

| | | | |
|---|---|---|---|
| DE | 198 22 021 | A1 | 12/1999 |
| DE | 198 49 739 | A1 | 5/2000 |
| EP | 0 690 656 | A2 | 1/1996 |
| EP | 0 982 971 | A2 | 3/2000 |
| EP | 1017253 | A2 | 7/2000 |
| JP | 06233389 | | 8/1994 |
| WO | WO 9320668 | | 10/1993 |
| WO | WO 01/10169 | A1 | 2/2001 |

* cited by examiner

*Primary Examiner*—Huyen Le
(74) *Attorney, Agent, or Firm*—Sughrue Mion, PLLC

(57) ABSTRACT

A hearing aid with a directional characteristic, including at least two spaced apart input transducers and wherein transducer signal type, such as transducer noise, wind noise, sound emitted from a sound source located in the surroundings of the hearing aid, distorted signals, such as clipped signals, slew rate limited signals, etc, is determined, and wherein signal processing in the hearing aid, such as transducer matching, filtering, signal combination, etc, is adapted according to the determined signal type. For example, the directional characteristic may be switched to an omnidirectional characteristic when at least one of the input transducer signals is dominated by noise or distortion, and/or adaptive matching of input transducers may be put on hold while at least one of the input transducer signals is dominated by noise or distortion.

14 Claims, 4 Drawing Sheets

HEARING AID WITH ADAPTIVE MATCHING OF INPUT TRANSDUCERS

This application is based on and claims priority from Danish application no. PA 2000 01475 filed Oct. 4, 2000, and European Patent Application No. 01610048.9 filed May 10, 2001, the disclosures of which are incorporated by reference herein.

FIELD OF THE INVENTION

The present invention relates to a hearing aid with a directional characteristic, comprising at least two spaced apart input transducers.

BACKGROUND OF THE INVENTION

Hearing aids comprising two input transducers and having a directional characteristic are well known in the art. A sound wave that impinges on a hearing aid of this type at a specific angle is received by the two input transducers with an arrival time difference defined by the distance between the input transducers, the velocity of sound, and the impinging angle. The output signals of the two input transducers are combined to form the directional characteristic of the hearing aid. When the output signal of the input transducer receiving the sound wave first is delayed by an amount that is equal to the arrival time difference of the corresponding sound wave and subtracted from the output signal of the other input transducer, the two output signals will cancel each other. Thus, a notch is created in the directional characteristic of the hearing aid at the receiving angle in question. By adjusting the delay of the input transducer signal before subtraction, the angular position of the notch in the directional characteristic may be adjusted correspondingly.

It is also well known that the frequency response of subtracted signals originating from a sound source in the surroundings of the hearing aid, i.e. the transducer signals are correlated signals, has a 6 dB/octave positive slope. Thus, low frequencies are attenuated for correlated signals while this is not the case for non-correlated signals, i.e. neither transducer noise nor wind noise is attenuated. Therefore, the signal to noise ratio is reduced in a prior art directional hearing aid compared to an omnidirectional hearing aid.

Notch formation requires that the two input transducers are identical, i.e. they have identical parameters, such as sensitivities and phase responses. Typically, identically manufactured input transducers exhibit sensitivity differences of the order of 6 dB and phase differences of the order of 10°. Directional characteristics can not be formed with input transducers with phase and sensitivity differences of this magnitude. Selection of paired input transducers may reduce the sensitivity differences to 0.5 dB and phase differences to 2° which may still not lead to notch formation in the directional characteristic. Further, aging may increase these differences over time.

In U.S. Pat. No. 6,272,229, a hearing aid with adaptive matching of input transducers is disclosed. According to the disclosure, differences in sensitivity and phase response are compensated utilizing specific circuitry continuously determining the differences and compensating for them. The differences are determined based on the sound signals received by the input transducers. No additional signals are needed. Selection of input transducers is eliminated and differences between circuitry processing each of the respective input transducer signals and differences created by aging or other influences are automatically compensated.

SUMMARY OF THE INVENTION

In a hearing aid with a plurality of input transducers, the output signals from the respective input transducers may not be generated from the same sound source. For example, when the hearing aid is operated in a silent environment, each of the input transducer signals contains only noise generated by the respective input transducer itself. Thus, in this case, the output signals are generated by independent and thus, non-correlated signal sources, namely the individual input transducers. Likewise, signals generated by the two input transducers in response to wind, i.e. wind noise, are not correlated since air flow at the hearing aid is turbulent. Thus, also in this case, the output signals are generated by independent signal sources. Further, the input transducer signals are clipped at high input levels by the A/D converters converting the input transducer signals to digital signals. Typically, signals are clipped at different signal levels because of different input transducer sensitivities and, thus, clipped signals may also be non-correlated and appear to have been generated by independent signal sources.

When the input transducer signals are generated by independent signal sources, the above-mentioned prior art input transducer matching technique falls apart since, typically, the determined phase and sensitivity differences will be dominated by differences in the generated signals and will not be related to differences in input transducer parameters.

It is an object of the present invention to provide a hearing aid with a directional characteristic that overcomes the above-mentioned disadvantages of the prior art.

This object is fulfilled by a hearing aid with a directional characteristic wherein transducer signal type, such as transducer noise, wind noise, sound emitted from a sound source located in the surroundings of the hearing aid, distorted signals, such as clipped signals, slew rate limited signals, etc, etc, is determined, and wherein signal processing in the hearing aid, such as transducer matching, filtering, signal combination, etc, is adapted according to the determined signal type. For example, the directional characteristic may be switched to an omnidirectional characteristic when at least one of the input transducer signals is dominated by noise or distortion, and/or adaptive matching of input transducers may be put on hold while at least one of the input transducer signals is dominated by noise or distortion.

Thus, the above-mentioned and other objects are fulfilled by a hearing aid comprising a first and a second input transducer for transforming an acoustic input signal into respective first and second input transducer signals, a first signal processor having a first input that is connected to the first input transducer signal and a second input that is connected to the second input transducer signal for generation of a third electrical signal by processing and combining the input signals, an output transducer for transforming the third electrical signal into an acoustic output signal, a correlation detector for detection of non-correlated first and second processor input signals and for generation of one or more control signals including a first control signal in response to the detection so that transducer signal processing can be adapted according to the detection.

The hearing aid may further comprise an adaptive matching circuit with first and second inputs that are connected with the respective first and second input transducer signals and first and second outputs that are connected to the respective first and second processor inputs for modification of amplitude and phase responses of the first and second output signals in response to determinations of difference in the amplitude and phase responses so that the resulting amplitude and phase responses of the first and second output signals are adjusted to be substantially identical, and wherein the correlation detector generates a second control signal that is connected to the adaptive matching circuit for inhibition of adaptive matching upon detection of non-correlated signals.

The first and second control signals may be identical signals.

In a hearing aid according to this embodiment of the present invention, transducer differences, such as differences in sensitivities, phase responses, etc, are continuously determined when the transducer signals are correlated, e.g. when the transducer signals are generated in response to a sound source located in the surroundings of the hearing aid so that in this case the hearing aid continuously adapts to changes in transducer parameters. When non-correlated signals are detected, e.g. when the transducer signals are dominated by non-correlated signals, such as when at least one transducer signal is dominated by, e.g. transducer noise, wind noise, signal clipping, etc, updating of determined values of differences in transducer parameters is not performed rather, for example, the transducer parameter compensating circuitry remains set according to the latest updated values of the differences.

The correlation detector may comprise one or more signal level detectors for detection of respective input transducer signal levels. For example, the first and the second control outputs may be set to a logic "1" when the detected signal level is greater than a predetermined threshold level such as 2 dB below the saturation level of the A/D converters for converting the input transducer signals to digital signals. The first and the second control outputs may be reset to a logic "0" when the detected signal levels return to values below the predetermined thresholds. The level detector may further have hysteresis so that the control outputs may be set when the detected signal level is above a first predetermined threshold level and reset when the detected signal level returns to a value below a second predetermined threshold level that is lower than the first threshold level.

The signal level may be an amplitude level, a root mean square level, a power level, etc, or the ratio between such levels and a corresponding reference quantity, e.g. in dB. Further, the level may be determined within a specific frequency range.

The signal level detectors may further comprise slew rate detectors for detection of rapid signal changes since slew rate limitations of circuitry that processes input transducer signals may distort these signals. The signal level detector may for example comprise a slew rate threshold so that the first control output is set e.g. to logic "1" if an increase in absolute value of the difference between one sample and the next is greater than or equal to the slew rate threshold.

Typically, wind noise generates transducer signals at very high levels even at low wind speeds thus, wind noise will typically be detected utilizing a signal level detector as described above.

The hearing aid may further comprise a frequency analyzer for determination of the frequency content of input transducer signals, e.g. for discrimination between signal type. For example, wind noise and clipped signals may be distinguished based on their frequency content, and signal processing may be adapted accordingly.

Further, the signal level detectors may be used for detection of the level of a noise signal whereby wind noise may be distinguished from transducer noise since, typically, transducer noise is a low level signal while wind noise is a high level signal.

Thus, according to the present invention, at least three types of signals may be identified, i.e. transducer noise signals, wind noise signals, and signals from sound sources located in the surroundings of the hearing aid. Further, distorted signal types, such as clipped signals, slew rate limited signals, etc, may be identified.

As already mentioned, transducer signals dominated by transducer noise, wind noise, and/or signal distortion are not correlated since the signal sources are substantially independent of each other. The opposite is true for transducer signals generated in response to a specific sound source located in the surroundings of the hearing aid. Such signals differ only by the arrival time difference caused by the distance between the transducers and by differences caused by transducer differences, i.e. such signals are highly correlated. Thus, signals of this type may be distinguished by calculation of cross-correlation values of input transducer signals.

According to an embodiment of the present invention, the correlation detector comprises a second signal processor that is adapted to calculate a cross-correlation value of signals derived from the transducer signals. Output transducer signals with a cross-correlation value within a predetermined range of cross-correlation values are treated as correlated signals.

For example, a cross-correlation value $r_0$ may be calculated as an approximation to or an estimate of a value r defined by the following equation:

$$r = \frac{\sum XY - \frac{\sum X \sum Y}{N}}{\sqrt{\left(\sum X^2 - \frac{(\sum X)^2}{N}\right)\left(\sum Y^2 - \frac{(\sum Y)^2}{N}\right)}}$$

wherein X is a sampled signal derived from the first signal, Y is a sampled signal derived from the second signal, and N is the number of samples.

It is noted that r ranges from −1 to 1 and that r=1 for identical signals X and Y and r=1 for inverted signals X and Y and r=0 for signals with no mutual correlation.

It is also noted that the equation is simplified for signals having DC-values equal to zero, i.e. $\Sigma X=0$ and $\Sigma Y=0$ in the equation.

In a preferred embodiment of the present invention, the correlation value $r_0$ is calculated from a particularly simple approximation to the equation wherein the signals X and Y are digitized in one bit words, i.e. the sign of the signals X and Y are inserted in the equation.

It is even more preferred to calculate the correlation value $r_0$ as a running mean value wherein a predetermined value $\Delta_1$ is added to the sum when sign(X)=sign (Y) and wherein a predetermined value $\Delta_2$ is added to the sum when sign(X) ≠sign (Y). If, for example, $\Delta_1=1$, and $\Delta_2=0$, r increases towards the value 1 when X and Y have identical signs, and r decreases towards ½ when X and Y have opposite signs. Since non-correlated signals, such as transducer noise or wind noise, change sign independently of each other and thus, will have identical signs half the time while signals generated in response to a specific sound source are highly correlated and have the same sign substantially all the time.

In an embodiment of the invention, the first signal processor is adapted to process the first and second electrical signals for formation of an omnidirectional characteristic upon detection of non-correlated signals, e.g. by signal level detection, by cross-correlation calculation, etc. The omnidirectional characteristic may be formed by selecting the first or the second electrical signal as the third electrical signal whereby signal to noise ration is improved compared to a directional characteristic, or, the omnidirectional characteristic may be formed by averaging the first and second electrical signals whereby signal to noise ratio may be further improved and clipping or slew rate distortion reduced if, for example, only one of the signals is clipped or slew rate limited.

BRIEF DESCRIPTION OF THE DRAWINGS

Still other objects of the present invention will become apparent to those skilled in the art from the following description wherein the invention will be explained in greater detail. By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawing.

DESCRIPTION OF PREFERRED EMBODIMENTS

Figure 1:
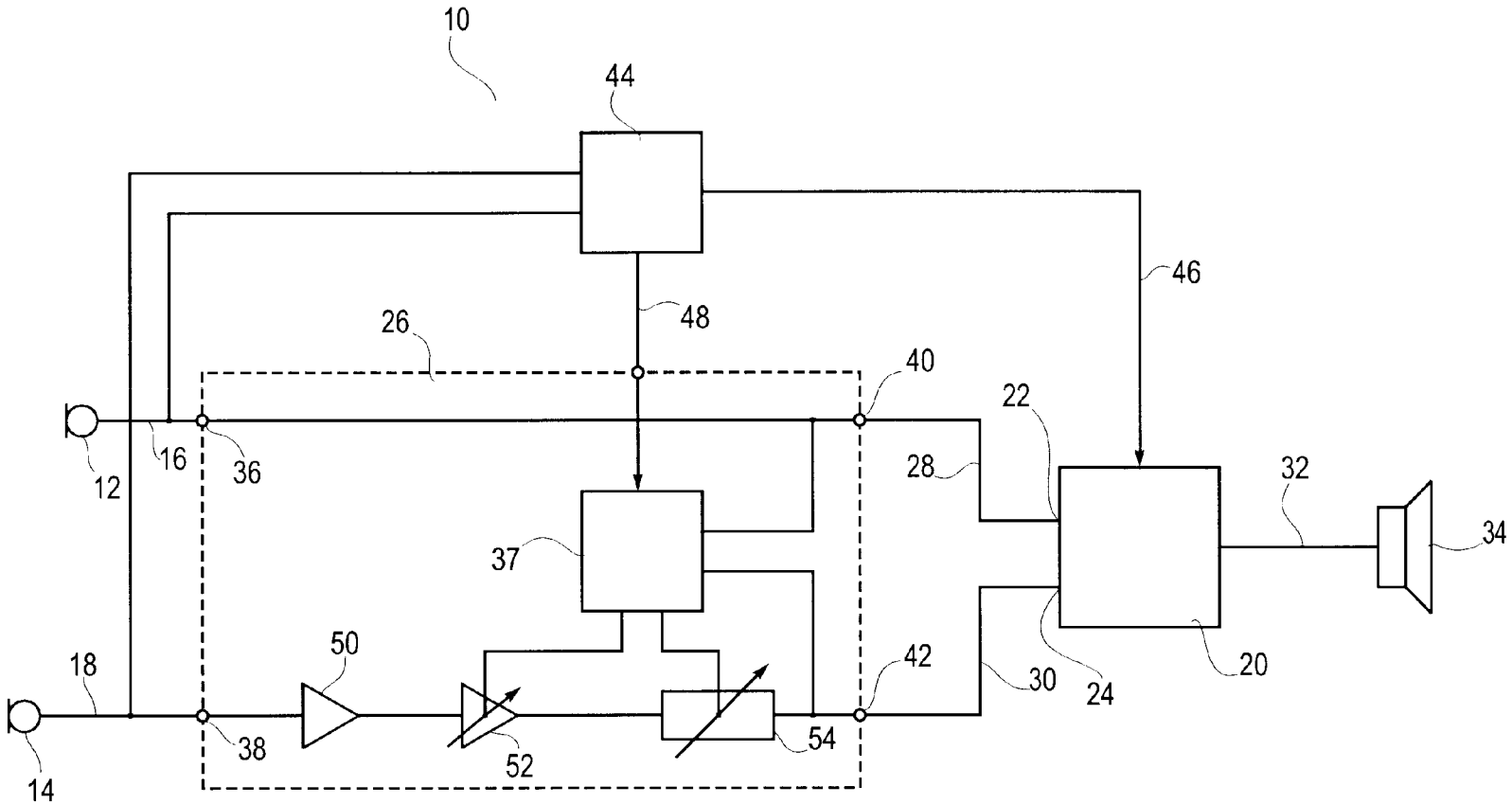
FIG. 1 shows a blocked schematic of a hearing aid according to the present invention.

It will be obvious for the person skilled in the art that the circuits shown in the drawing may be realized using digital or analogue circuitry or any combination hereof. In the present embodiment, digital signal processing is employed and thus, the signal processing circuits comprise digital signal processing circuits. For simplicity, the A/D and D/A converters are not shown in the drawing. In the present embodiment, all the digital circuitry of the hearing aid may be provided on a single digital signal processing chip or, the circuitry may be distributed on a plurality of integrated circuit chips in any appropriate way.

FIG. 1 shows a blocked schematic of a hearing aid 10 comprising a first input transducer 12 and a second input transducer 14 for transforming an acoustic input signal into respective first and second input transducer signals 16, 18. The input transducer signals 16, 18 are converted to digital signals by A/D converters (not shown). A first signal processor 20 has a first input 22 that is connected to the first input transducer signal 16 and a second input 24 that is connected to the second input transducer signal 18 via an adaptive matching circuit 26. The processor 20 processes and combines the processor input signals 28, 30 for generation of a third electrical signal 32. An output transducer 34 transforms the third electrical signal 32 into an acoustic output signal.

The adaptive matching circuit 26 has first and second inputs 36, 38 that are connected with the respective first and second input transducer signals 16, 18 and first and second outputs 40, 42 that are connected to the respective first and second processor inputs 22, 24. The circuit 26 modifies amplitude and phase responses of the first and second output signals 28, 30 in response to determinations of differences in the amplitude and phase responses so that the amplitude and phase responses of the first and second output signals 28, 30 are adjusted to be substantially identical.

A correlation detector 44 is connected to the input transducer signals 16, 18 and detects presence of non-correlated signals and generates first and second control signals 46, 48 in response to the detection so that signal processing in the hearing aid can be adapted according to the detection.

The first control signal 46 is connected to the first signal processor 20 for controlling the way in which the first signal processor combines the first and second processor input signals 28, 30, e.g. by combining the first and second processor input signals 28, 30 for omnidirectional sound reception upon detection of non-correlated transducer signals.

The second control signal 48 is connected to the adaptive matching circuit 26 for inhibition of adaptive matching upon detection of non-correlated signals.

The adaptive matching circuit 26 has an inverter 50 connected in series with an adjustable gain amplifier 52 that is connected in series with an adjustable delay 54. The nominal delay of adjustable delay 54 equals the distance between the first and second input transducer 12, 14 divided by the velocity of sound so that, nominally, the directional characteristic of the hearing aid contains a notch in the direction of a line extending from the first input transducer 12 to the second input transducer 14. A matching controller 37 determines differences in amplitude and phase of the input transducer signals 16, 18 and adjusts the amplifier 52 and the delay 54 in response to the determinations so that the amplitude and phase responses of the first and second output signals 28, 30 are adjusted to be substantially identical.

Figure 2:
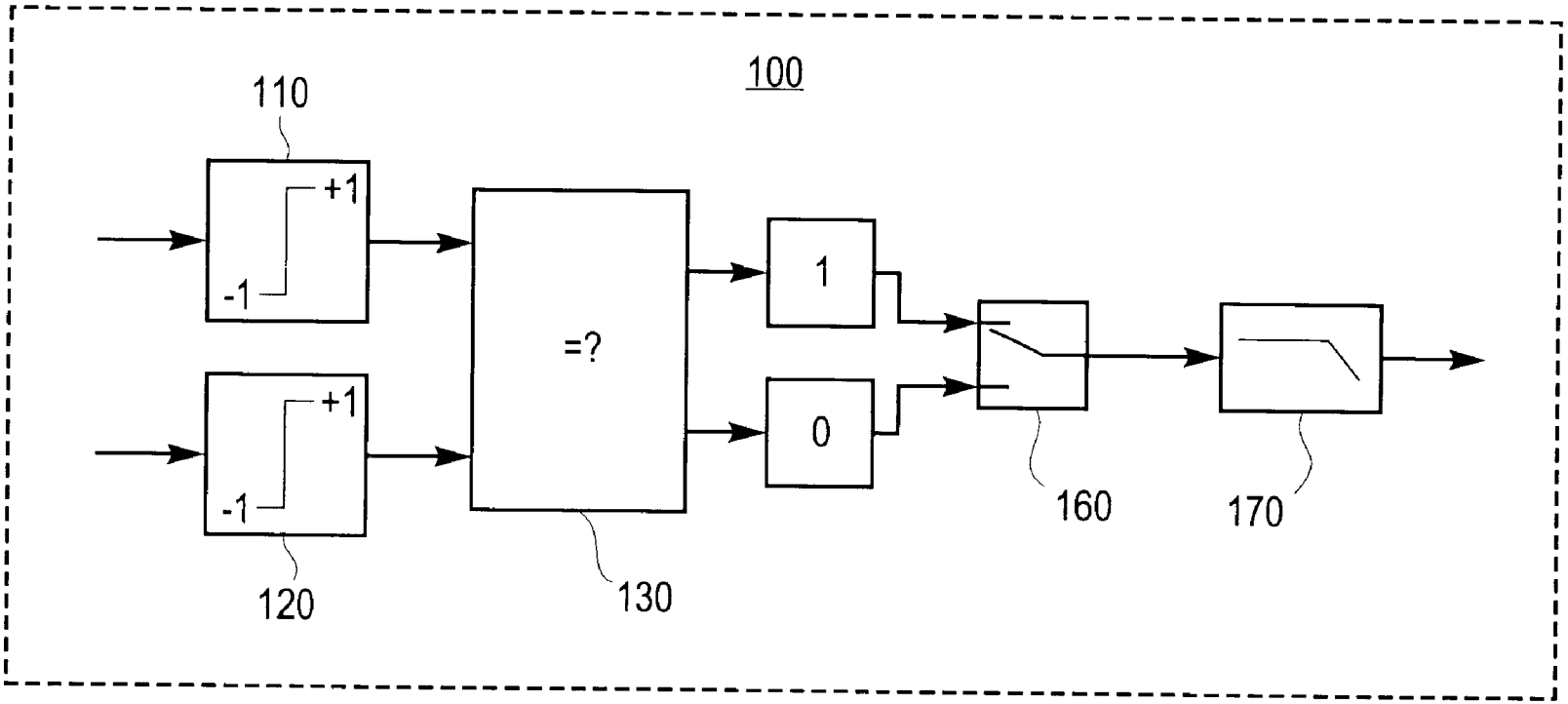
FIG. 2 shows a blocked schematic of a second signal processor according to the present invention.

FIG. 2 shows a blocked schematic of a second signal processor 100 according to the present invention and included in the correlation detector 44 wherein the correlation value r is calculated as a running mean value. The signals X, Y may be the input transducer signals 16, 18 or band pass filtered versions of the signals 16, 18. The signals X, Y are input to sign blocks 110, 120 that output sign (X) and sign (Y), respectively, to the comparator 130 and if sign(X)=sign (Y) a predetermined value $\Delta_1=1$ is added to the sum in adder 160 and if sign(X)≠sign (Y), $\Delta_2=0$ is added to the sum in adder 160. The low pass filter 170 averages the sum output from the adder 160 in an appropriate time interval, such as 10 ms. If $\Delta_1=1$ and $\Delta_2=-1$, a closer approximation to r is obtained by the running mean value.

Figure 3:
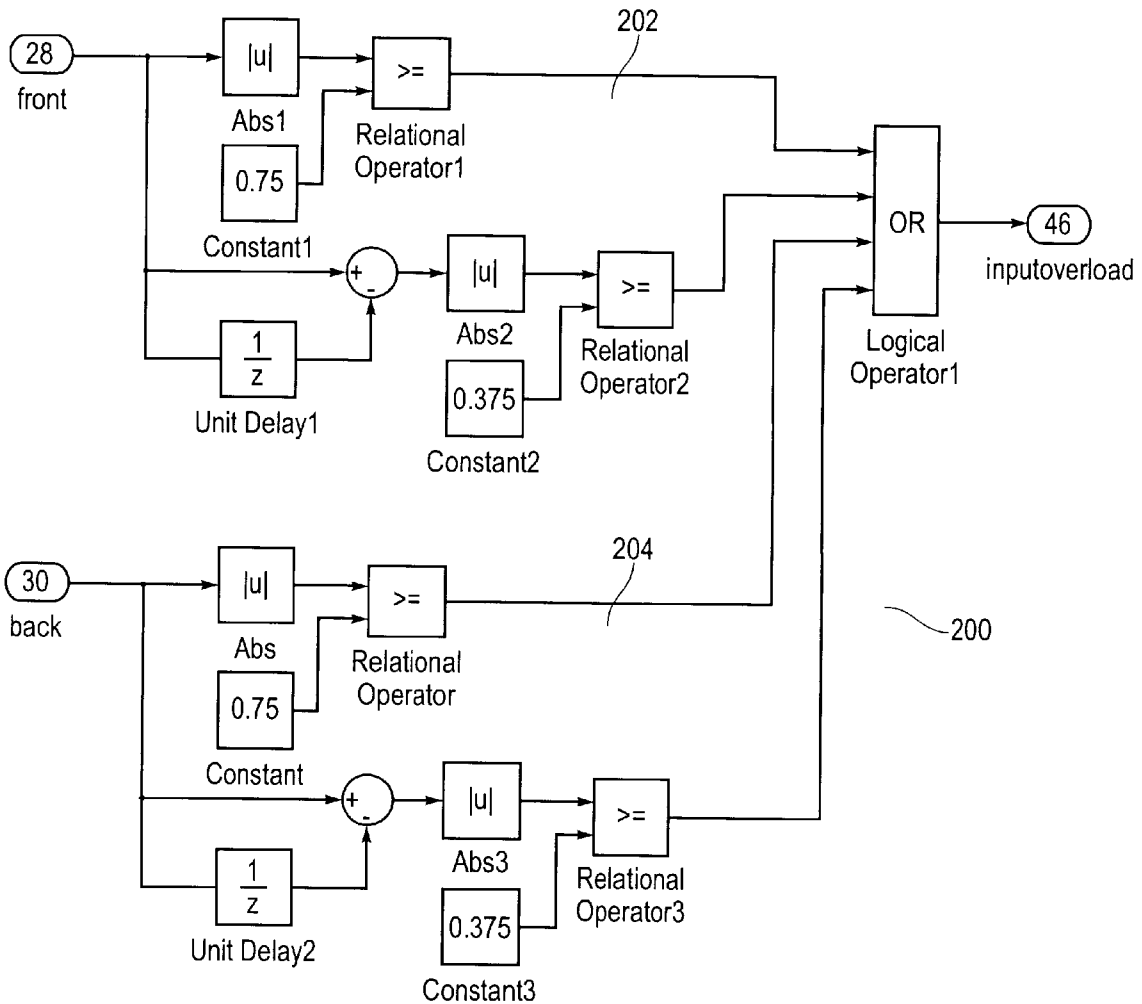
FIG. 3 shows a blocked schematic of a level detector.

FIG. 3 shows a blocked schematic of a signal level detector 200 included in the correlation detector 44, comprising a first signal level detector 202 that is connected to the first input transducer signal 16 and a second signal level detector 204 that is connected to the second input transducer signal 18. The level detector 200 sets a control output 46 to a logic "1" if one of the processor input signals 28, 30 is more than approximately 2.5 dB from the saturation level (clipping level) of the A/D converters (not shown). In the present embodiment, the A/D converters are sigma delta converters having a slew rate of 0.5 for successive samples (theoretical limit: ±1). Therefore, the control output 46 is also set to a logic "1" if the increase in absolute value of the difference between one sample and the next is 0.375 or higher.

Figure 4:
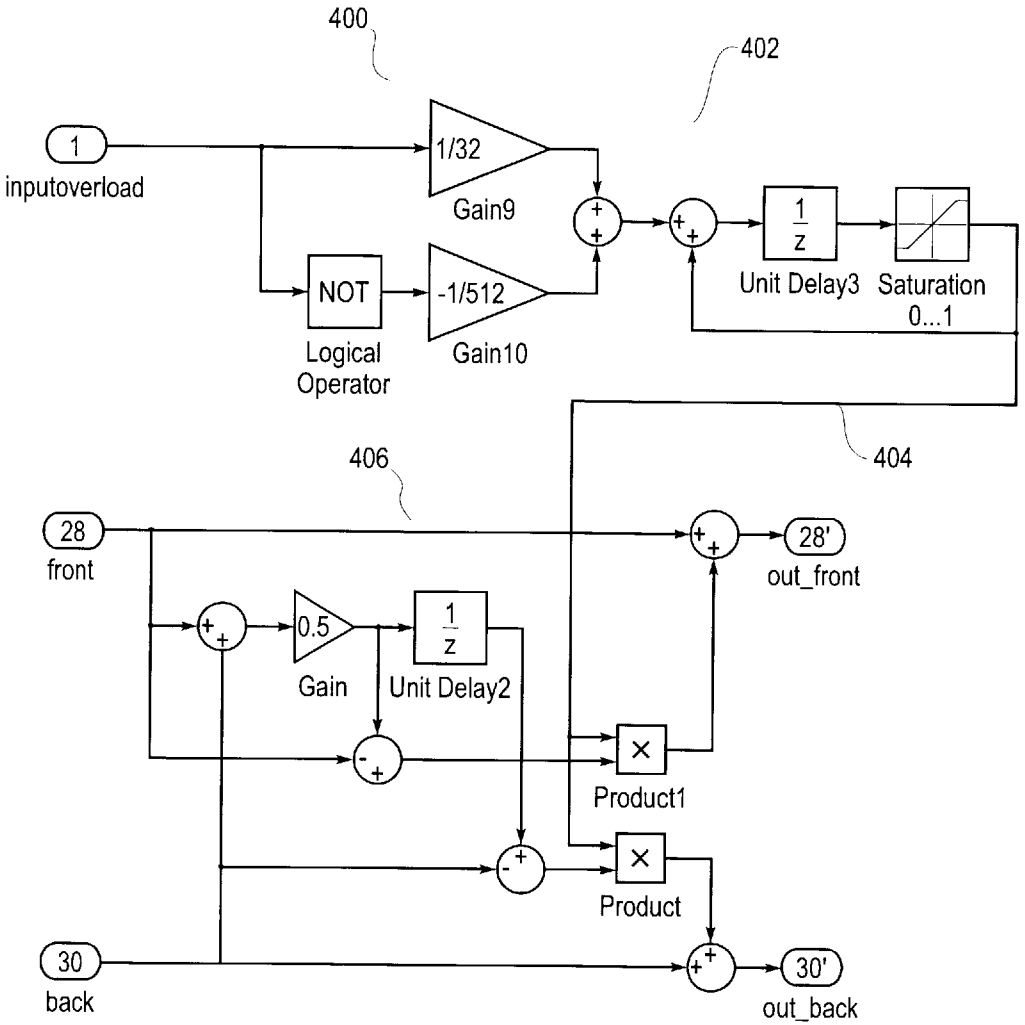
FIG. 4 shows a blocked schematic of input circuitry of the first signal processor.

FIG. 4 shows an input circuit 400 of the first signal processor 20. When the control signal 46 is a logic "1", the counter 402 is incremented from 0 to one in 32 clock cycles, i.e. in 1 ms, and when the control signal 46 goes low, the counter 402 is decremented form one to 0 in 512 clock cycles, i.e. in 16 ms. The person skilled in the art will appreciate that the modified signals 28', 30' are identical to the respective processor input signals 28, 30 when the counter output signal 404 is logic "0", and in general that:

signal 28'=signal 28+counter output 404 (½(signal 28+signal 30)−signal 28), and signal 30'=signal 30+counter output 404 (½(signal 28+signal 30)$z^{-1}$−signal 30), whereby a smooth transition from a directional characteristic to an omnidirectional characteristic and vice versa is obtained. In the first signal processor 20, the signals 28', 30' are summed into the third electrical signal 32. It will be appreciated that when the counter output 404 is equal to 1, the circuitry 406 simulates that an acoustic signal corresponding to the average of signals 28, 30 impinges on the hearing aid from a frontal direction whereby an omnidirectional characteristic is obtained.

In an alternative embodiment, the directional characteristic of the hearing aid is controlled by adjustment of an attenuation control parameter as disclosed in U.S. patent application Ser. No. 09/696,264.

What is claimed is:

1. A hearing aid comprising a first and a second input transducer for transforming an acoustic input signal into respective first and second input transducer signals, a first signal processor having a first input that is connected to the first input transducer signal and a second input that is connected to the second input transducer signal for generation of a third electrical signal by processing and combining the input signals, an output transducer for transforming the third electrical signal into an acoustic output signal, an adaptive matching circuit with first and second inputs that are connected with the respective first and second input transducer signals and first and second outputs that are connected to the respective first and second processor inputs for modification of amplitude and phase responses of the first and second output signals in response to determinations of difference in the amplitude and phase responses so that the amplitude and phase responses of the first and second output signals are substantially identical, and a correlation detector for detection of non-correlated first and second processor input signals and for generation of a first control signal in response to the detection so that signal processing in the hearing aid can be adapted according to the detection, wherein the correlation detector generates a second control signal that is connected to the adaptive matching circuit for inhibition of adaptive matching upon detection of non-correlated signals.

2. A hearing aid according to claim 1, wherein the correlation detector comprises a first signal level detector for detection of first signal levels.

3. A hearing aid according to claim 1, wherein the correlation detector further comprises a second signal level detector for detection of second signal levels.

4. A hearing aid according to claim 1, wherein the correlation detector comprises a second signal processor that is adapted to calculate a cross-correlation value of signals derived from the first and second signals.

5. A hearing aid according to claim 1, wherein the first control signal is connected to the first signal processor for controlling the way in which the first signal processor combines the first and second processor input signals.

6. A hearing aid according to claim 5, wherein the first signal processor combines the first and second processor input signals for omnidirectional sound reception.

7. A hearing aid comprising:

a first and a second input transducer for transforming an acoustic input signal into respective first and second input transducer signals, a first signal processor having a first input that is connected to the first input transducer signal and a second input that is connected to the second input transducer signal for generation of a third electrical signal by processing and combining the input signals, an output transducer for transforming the third electrical signal into an acoustic output signal, a correlation detector for detection of non-correlated first and second processor input signals and for generation of a first control signal in response to the detection so that signal processing in the hearing aid can be adapted according to the detection, wherein the correlation detector comprises a second signal processor that is adapted to calculate a cross-correlation value r0 as an approximation to or an estimate of a value r defined by the following equation:

$$r = \frac{\sum XY - \frac{\sum X \sum Y}{N}}{\sqrt{\left(\sum X^2 - \frac{(\sum X)^2}{N}\right)\left(\sum Y^2 - \frac{(\sum Y)^2}{N}\right)}}$$

wherein X is a sampled signal derived from the first signal, Y is a sampled signal derived from the second signal, and N is the number of samples.

8. A hearing aid according to claim 7, wherein the signals X and Y are digitized in one bit words.

9. A hearing aid according to claim 7, wherein the correlation value $r_0$ is calculated as a running sum wherein a predetermined value $\Delta_1$ is added to the sum when sign (X)=sign (Y) and wherein a predetermined value $\Delta_2$ is added to the sum when sign(X)≠sign (Y).

10. A hearing aid according to claim 9, wherein $\Delta_1$ is equal to one and $\Delta_2$ is equal to zero.

11. A hearing aid comprising a first and a second input transducer for transforming an acoustic input signal into respective first and second input transducer signals, a first signal processor having a first input that is connected to the first input transducer signal and a second input that is connected to the second input transducer signal for generation of a third electrical signal by processing and combining the input signals, an output transducer for transforming the third electrical signal into an acoustic output signal, a correlation detector for detection of non-correlated first and second processor input signals and for generation of a first control signal in response to the detection so that signal processing in the hearing aid can be adapted according to the detection, and means for detecting and limiting a slew rate of at least one of the input transducer signal levels.

12. A hearing aid comprising a first and a second input transducer for transforming an acoustic input signal into respective first and second input transducer signals, a first signal processor having a first input that is connected to the first input transducer signal and a second input that is connected to the second input transducer signal for generation of a third electrical signal by processing and combining the input signals, an output transducer for transforming the third electrical signal into an acoustic output signal, a correlation detector for detection of non-correlated first and second processor input signals and for generation of a first control signal in response to the detection so that signal processing in the hearing aid can be adapted according to the detection, wherein the first signal processor is adapted to process the first and second electrical signals for formation of an omnidirectional characteristic upon detection of non-correlated signals.

13. The hearing aid according to claim 12, wherein the omnidirectional characteristic is formed by selecting one of said first and said second input transducer signals as the third electrical signal.

14. The hearing aid according to claim 12, wherein the omnidirectional characteristic is formed by averaging the first and second input transducer signals.

* * * * *